United States Patent [19]

Matsuo et al.

[11] Patent Number: 4,626,257

[45] Date of Patent: Dec. 2, 1986

[54] METHOD FOR DYEING POLYESTER FIBER MATERIALS: DISPERSE DYE COMBINATIONS WITH COMPENSATED COLOR FADING

[75] Inventors: Yoshikazu Matsuo; Toshio Nakamatsu, both of Osaka; Toshikazu Moriwaki, Hyogo; Sadaharu Abeta; Kunihiko Imada, both of Osaka, all of Japan

[73] Assignee: Sumitomo Chemical Company, Limited, Osaka, Japan

[21] Appl. No.: 732,768

[22] Filed: May 10, 1985

[30] Foreign Application Priority Data

May 10, 1984 [JP] Japan ..... 59-94372

[51] Int. Cl.[4] ..... D06P 3/54; D06P 1/16

[52] U.S. Cl. ..... 8/638; 8/400; 8/639; 8/643; 8/675; 8/679; 8/691; 8/692; 8/922

[58] Field of Search ..... 8/638, 400, 639, 643

[56] References Cited

U.S. PATENT DOCUMENTS

| | | | |
|---|---|---|---|
| 3,042,476 | 7/1962 | Rohrner | 8/638 |
| 3,368,864 | 2/1968 | Gugerli | 8/638 |
| 3,617,170 | 11/1971 | Hansen et al. | 8/638 |
| 3,767,357 | 10/1973 | Spietschka et al. | 8/638 |
| 4,185,959 | 1/1980 | Imada et al. | 8/638 |
| 4,255,154 | 3/1981 | Zurbuchen et al. | 8/638 |
| 4,432,770 | 2/1984 | Hasler et al. | 8/638 |
| 4,548,613 | 10/1985 | Bode et al. | 8/638 |

FOREIGN PATENT DOCUMENTS

| | | |
|---|---|---|
| 50-111379 | 8/1975 | Japan . |
| 57-191522 | 11/1982 | Japan . |
| 58-22593 | 5/1983 | Japan . |

*Primary Examiner*—A. Lionel Clingman

*Attorney, Agent, or Firm*—Sughrue, Mion, Zinn, Macpeak and Seas

[57] ABSTRACT

A method for dyeing polyester fiber materials is disclosed, comprising conducting combination dyeing by a combination of disperse dyes each capable of making up for the color fading of other disperse dye produced upon exposure to sunlight, by the color change thereof in hue caused upon the exposure to sunlight under the same condition.

6 Claims, No Drawings

METHOD FOR DYEING POLYESTER FIBER MATERIALS: DISPERSE DYE COMBINATIONS WITH COMPENSATED COLOR FADING

This invention relates to an advantageous method for dyeing fiber materials which are specially required to have a superior light fastness.

Recently, the use of polyester fiber materials is increasing as car interior materials because of their superior thermal resistance and light resistance. Therefore, a disperse dye which is a coloring agent for them has been required to have more superior light fastness, especially at high temperatures. Hitherto, the light fastness is examined by exposure at a temperature of 63±3° C. for 20 to 40 hours provided by JIS-L0842, but the light fastness for use of car interior is required to be endurable to high temperatures of 83±3° C. for 400 to 600 hours. Furthermore, in the use of car seat which is prepared from polyester fiber materials covering polyurethane foam with a regenerativity, the temperature of the seat often rises to 83±3° C. or higher and hence, dyes which are endurable to more severe condition have been demanded.

In general, in order to obtain a desired hue, two or more dyes having a different hue are combined, but even if dyes, each having a good light fastness, are selected and combination dyeing is performed, when long time exposure to light is conducted at a high temperature of 83±3° C. as in car interior or house interior use, even a little difference in light fastnesses among the dyes used is enlarged and ultimately leads to remarkable color change or fading on the exposed area and, thus, it is generally difficult to obtain a desired light fastness.

The present inventors have extensively studied disperse dyes which give dyed products having a superior light fastness endurable to the light resistance test under a severe condition such as car interior uses. As a result, they have found that the problems above can be resolved by a combined use of dyes which can make up for color fading of other dyes by color change in the exposed area and, thus, this invention has been completed based on these findings.

An object of this invention is to provide a method for dyeing polyester fiber materials comprising conducting combination dyeing by a combination of disperse dyes which can make up for the color fading of other disperse dyes produced upon exposure of dyed products to sunlight, by their color change in hue caused upon the exposure to sunlight under the same condition.

In this invention, the term "color fading" means a lowering of color density of the dyed product, and the term "color change" means change of hue of the dyed product.

DETAILED DESCRIPTION OF THE INVENTION

In this invention, the selection of dyes which can make up for the color fading of other dyes by their change of the hue, for example, can be carried out as follows:

As a method evaluating the color change and fading of dyed products with respect to each dye, a visual evaluation by means of a gray scale for the color change and fading as provided by JIS-L0804 is usually employed. Furthermore, as a quantitative evaluation method, there is a computer color matching method (hereinafter referred to as CCM) as described in the Japanese Patent Application (OPI) No. 191522/82 (the term "OPI" as used herein refers to a "published unexamined Japanese patent application open to public inspection"). This method evaluates both an exposed area and non-exposed area. That is, for example, in the case that the dye has a blue color, the color change after the exposure is represented by the color change to yellow and red, and each degree is calculated by the following equation:

$$\begin{pmatrix}\text{ratio of}\\ \text{color change}\\ \text{to yellow}\end{pmatrix} = \frac{\begin{pmatrix}\textit{CCM}\text{ value of yellow}\\ \text{component in the}\\ \text{exposed area}\end{pmatrix} - \begin{pmatrix}\textit{CCM}\text{ value of yellow}\\ \text{component in the}\\ \text{non-exposed area}\end{pmatrix}}{\begin{pmatrix}\textit{CCM}\text{ value of blue component}\\ \text{in the non-exposed area}\end{pmatrix}} \times 100\ (\%)$$

$$\begin{pmatrix}\text{ratio of}\\ \text{color change}\\ \text{to red}\end{pmatrix} = \frac{\begin{pmatrix}\textit{CCM}\text{ value of red}\\ \text{component in the}\\ \text{exposed area}\end{pmatrix} - \begin{pmatrix}\textit{CCM}\text{ value of red}\\ \text{component in the}\\ \text{non-exposed area}\end{pmatrix}}{\begin{pmatrix}\textit{CCM}\text{ value of blue component}\\ \text{in the non-exposed area}\end{pmatrix}} \times 100\ (\%)$$

Also, the degree of color fading of blue component is calculated by the following equation:

$$\begin{pmatrix}\text{ratio of}\\ \text{color fading}\end{pmatrix} = \frac{\begin{pmatrix}\textit{CCM}\text{ value of blue component}\\ \text{in the exposed area}\end{pmatrix}}{\begin{pmatrix}\textit{CCM}\text{ value of blue component}\\ \text{in the non-exposed area}\end{pmatrix}} \times 100\ (\%)$$

Thus, the color change and color fading after the exposure in light resistance test can be predicted from the color change (ratio) and color fading (ratio) of each dye obtained, and it is possible in the combination dyeing to combine dyes which can make up for the color fading of other dyes by the color change thereof.

The method of this invention is advantageous to dye polyester fiber house interior materials or car interior materials which are required to have a superior light fastness. In the case of dyeing such polyester fibers, for example, the following examples of the three primary colors selected by the above method can be illustrated as combinations of compounded disperse dyes.

That is, as blue disperse dyes, an anthraquinone dye represented by the general formula (1):

(1)

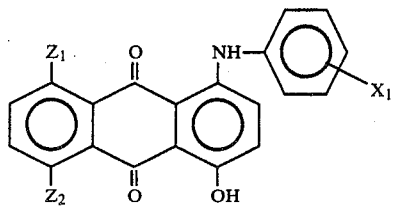

wherein $X_1$ is a halogen atom or a hydrogen atom, and one of $Z_1$ and $Z_2$ is a nitro group and the other is a hydroxy group, and an anthraquinone dye represented by the following formula (2):

(2)

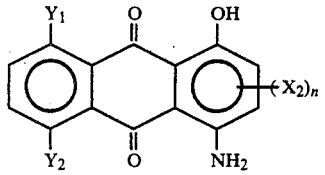

wherein one of $Y_1$ and $Y_2$ is an amino group and the other is a hydroxy group, $X_2$ is a halogen atom, and n is an integer of from 0 to 3, can be combined.

As yellow disperse dyes, at least one dye selected from the anthraquinone dyes represented by the general formulae (3), (4) and (5):

(3)

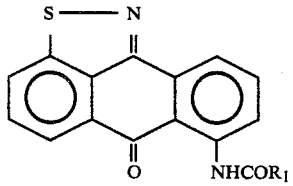

(4)

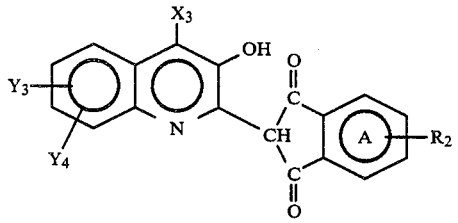

(5)

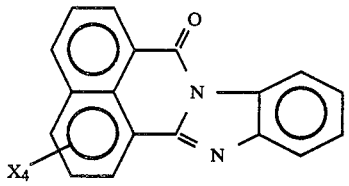

wherein $R_1$ is an alkyl group having from 1 to 4 carbon atoms or a phenyl group; $X_3$ is a hydrogen atom or a halogen atom; $Y_3$ and $Y_4$ are each a hydrogen atom or a halogen atom; $R_2$ is a hydrogen atom or an alkoxycarbonyl group; the ring A may be a naphthalene ring; and $X_4$ is a hydrogen atom, an alkyl group having from 1 to 4 carbon atoms, or an alkoxy group having from 1 to 4 carbon atoms, or a mixed dye of at least one selected from anthraquinone dyes of the general formulae (3), (4), and (5) and a dye represented by the general formula (6):

(6)

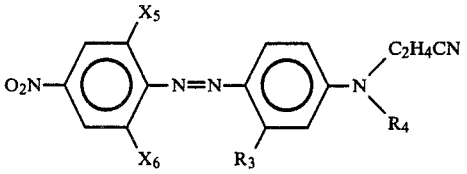

wherein $X_5$ and $X_6$ are each a halogen atom, $R_3$ is a hydrogen atom, a halogen atom, or a methyl group, and $R_4$ is a cyanoethyl group, an acetoxyethyl group, a benzoyloxyethyl group, or a phenoxyethyl group, can be employed.

As red disperse dyes, anthraquinone dyes represented by the general formulae (7) and/or (8):

(7)

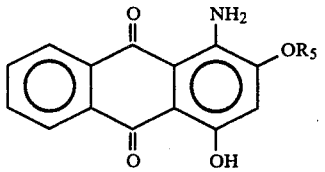

(8)

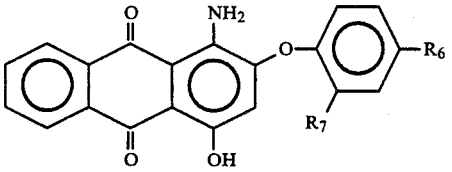

wherein $R_5$ is a substituted or unsubstituted alkyl group, in which examples of the substituent include a phenoxy or phenyl group which may be substituted with a hydroxy group or a halogen atom; $R_6$ is a hydrogen atom, a halogen atom, a substituted or unsubstituted alkoxy group, a substituted or unsubstituted alkyl group, an alkyl-substituted aminosulfonyl group, or an acyloxy group which examples of the substituent for the alkoxy group include an acetyl group, a carboalkoxy group, a phenylalkyl group, a phenoxyalkyl group, and a cyano group, and examples of the substituent for the alkyl group include a carboalkoxy group and a lactam group; and $R_7$ is a hydrogen atom or an alkyl group can be used.

In this invention, the dyes stated above can be properly used, however, suitable schemes of combination of dyes are as follows: A combination of the dye of the general formula (1) with the dye of the general formula (2) can be used as a blue disperse dye. In compliance with a desired hue, a combination of dyes of the general formulae (1) and (2) with at least one selected from yellow disperse dyes, i.e., the dyes of the general formulae (3), (4) and (5), or with a mixed dye of at least one selected from dyes of the general formulae (3), (4) and (5) and the dye of the general formula (6) can be employed as a compounded dye having two primary colors. Further, as a compounded dye having two primary colors, a combination of the dyes of the general formulae (1) and (2) with red disperse dyes, i.e., dyes of the general formulae (7) and/or (8) can be used. As a compounded dye with three primary colors, a combination of the blue disperse dye with the yellow disperse dye and the red disperse dye above can be employed.

To perform dyeing in a combination of these two or three primary colors, the dyes can be added to a dyeing bath individually, or prior to the dyeing, a dye composition having two or three primary colors is prepared, and the dye composition can be added to a dyeing bath. A combination ratio of 5 to 95% by weight of each one primary color dye to the weight of the dye composition can be employed.

If the dyeing is performed in a combination of the three primary color components selected from the dyes of the general formulae (1) and (3), (4) or (5), and (7), the light fastness of the dyed product is superior in blue hue, but in red hue such as beige, brown, or crimson, the color fading of red component is prominent and it is difficult to obtain a sufficient light fastness. However, by combining a proper quantity of the compound of the general formula (2) with the compound of the general formula (1) as a blue component, the light fastness which is insufficient in red hue up to now as stated above, is extremely improved. This fact shows that color shade of dyed material with the compound of the general formula (2) used changes to a reddish color by exposure for a long period of time at 83° C. to make up for the color fading of red component and the color fading proceeds keeping a ratio of the three primary color components nearly same. Thus, the color change after the exposure is little and, apparently, an extremely superior light fastness can be obtained.

A combination ratio of the compounds of the general formulae (1) and (2) used as the blue component is not specially limited, but a preferable ratio of the dyes of the general formulae (1) and (2) is from 20:80 to 95:5.

Similar to the blue component, with respect to the yellow component, by combining the compound of the general formula (6) with at least one of the compound of the general formulae (3), (4) and (5), color shade of dyed material with the compound of the general formula (6) changes to a reddish color to make up for the color fading of the red component, and a harmony of the color fading in the blue and red components can be maintained. Also, with regard to the red component, by combining the compound of the general formula (8) with the compound of the general formula (7), color shade of dyed material with the compound of the general formula (8) becomes more bluish color and can make up for the color fading of the blue component.

As can be seen, by making up for the color fading of some dye by the color change of other dye, a component ratio of the three primary colors is kept nearly the same before or after the exposure in the light resistance test, and the lowering of the color density can be minimized after the exposure. Thus, an extremely superior light fastness can be obtained.

In the dyeing of polyester fibers, by using an ultraviolet light absorber jointly, dyed products having a more superior light fastness can be obtained. Examples of the ultraviolet light absorber used in this invention include 2-(2'-hydroxyphenyl)-5-chlorobenzotriazole, 2-(2'-hydroxy-4'-methylphenyl)-5-chlorobenzotriazole, 2-(2'-hydroxy-4'-ethylphenyl)-5-chlorobenzotriazole, 2-(2'-hydroxy-3'-tert-butyl-5'-methylphenyl)-5-chlorobenzotriazole, 2-(2'-hydroxy-3',5'-di-tert-butylphenyl)-5-chlorobenzotriazole, 2-(2',4'-dihydroxyphenyl)-5-chlorobenzotriazole, 2-(2'-hydroxy-4'-propylphenyl)-5-chlorobenzotriazole, 2-(2'-hydroxy-4'-methoxyphenyl)-5-chlorobenzotriazole, 2-(2'-hydroxy-4'-ethoxyphenyl)-5-chlorobenzotriazole, 2-(2'-hydroxy-4'-propoxyphenyl)-5-chlorobenzotriazole, 2-(2'-hydroxy-5'-methylphenyl)-5-chlorobenzotriazole, 2-(2'-hydroxy-5'-ethylphenyl)-5-chlorobenzotriazole, and 2-(2'-hydroxy-5'-propylphenyl)-5-chlorobenzotriazole. These compounds may be used alone or in mixture. The addition amount thereof is not specially limited but preferably is from 0.5 to 5% to weight of a material to be dyed.

In this invention, the dyeing per se can be carried out according to known methods. In the case of dyeing polyester fibers, firstly disperse dyes in an amount required to obtain a desired hue and if desired, an ultraviolet light absorber are added to a dyeing bath, and the pH of the dyeing bath is adjusted at 4 to 5 by the addition of a pH buffer aqueous solution comprising acetic acid or acetic acid and sodium acetate. If desired, proper amounts of a metal ion blockading agent and a leveling agent are added to the dyeing bath, and the material to be dyed is then put in the dyeing bath. The dyeing bath is heated with stirring (for example, at a rate of 1° to 3° C. per minute), and the dyeing is performed at a prescribed temperature of 100° C. and over (for example, 110° to 135° C.) for 30 to 60 minutes. The dyeing time may be shortened by the condition of the dyeing. After the dyeing, the dyed material is cooled and washed with water and if desired treated by reduction cleaning, washed with water, and then dried to complete the finishing.

Specifically, the method of this invention is advantageous to dip dyeing.

This invention will now be explained in more detail by reference to the following examples, and the term "part" means weight part and the term "%" means weight percent.

EXAMPLE 1

A dyeing bath was prepared from 1,000 parts of a dye dispersion comprising 0.9 part of a yellow dye represented by the following formula (9) (prepared by finely granulating a mixture of 30% of the dye bulk and 70% of an anionic surfactant and drying):

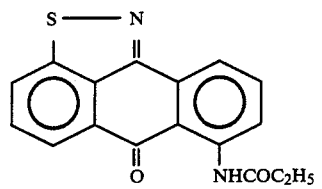

(9)

0.9 part of a yellowish orange dye represented by the following formula (10) (prepared by finely granulating a mixture of 30% of the dye bulk and 70% of an anionic surfactant and drying):

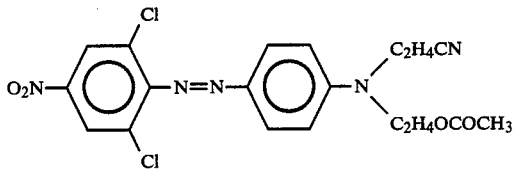

(10)

2.5 parts of a red dye represented by the following formula (11) (prepared by finely granulating a mixture of 30% of the dye bulk and 70% of an anionic surfactant and drying):

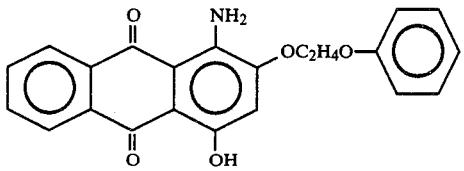

(11)

1.35 parts of a blue dye represented by the following formula (12) (prepared by finely granulating a mixture of 30% of the dye bulk and 70% of an anionic surfactant and drying):

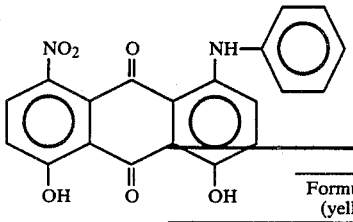

(12)

and 0.65 part of a blue dye represented by the following formula (13) (prepared by finely granulating a mixture of 30% of the dye bulk and 70% of an anionic surfactant and drying):

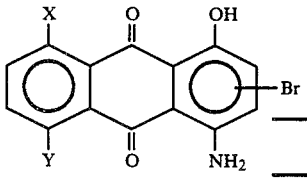

(13)

(a mixture of the compounds wherein one of X and Y is an amino group, and the other is a hydroxy group), and the pH of the dyeing bath was adjusted at 5 by the addition of acetic acid and sodium acetate. 100 parts of a polyester fiber-raised fabric was put in the dyeing bath, the temperature of the dyeing bath was elevated from 60° C. to 130° C. at a rate of 1° C. per minute, and the dyeing was conducted at 130° C. for 60 minutes. The dyed fabric was treated by reduction cleaning by usual manners and dried. The dyed product thus obtained had a dark brown color.

As Comparative Example 1, a dark brown dyed product was obtained in the same manner as in Example 1 except that the blue dye of the formula (12) was not used and the amount of the blue dye of the formula (13) was changed to 1.35 parts.

As Comparative Example 2, a brown dyed product was obtained in the same manner as in Example 1 except that the blue dye of the formula (13) was not used and the amount of the blue dye of the formula (12) was changed to 2.7 parts.

Light Fastness Test

Each of the dyed products obtained was backed with a urethane foam and irradiated for 600 hours by means of a fademeter (temperature of black panel: 83° C.), and then was evaluated for color change and fading by means of a gray scale. The results obtained are shown in Table 1.

As is shown in Table 1, the light fastness of the dyed product in Example 1 was extremely superior as compared with that of the dyed products in Comparative Examples 1 and 2.

TABLE 1

| | Formulation of Compounded Dye (part) | | | | | |
|---|---|---|---|---|---|---|
| | Formula (9) (yellow) | Formula (10) (yellowish orange) | Formula (11) (red) | Formula (12) (blue) | Formula (13) (blue) | Light Fastness |
| Example 1 | 0.9 | 0.9 | 2.5 | 1.35 | 0.65 | Grade 3–4 |
| Comparative Example 1 | 0.9 | 0.9 | 2.5 | — | 1.35 | Grade 2 |
| Comparative Example 2 | 0.9 | 0.9 | 2.5 | 2.7 | — | Grade 2–3 |

EXAMPLE 2

A dyed product was obtained in the same manner as in Example 1 except that the dyes of the formulae (9), (11), (12) and (13) were used with the formulation shown in Table 2.

As Comparative Example 3, a dyed product was obtained in the same manner as in Example 2 except that the blue dye of the formula (13) was not used.

The dyed products obtained in Example 2 and Comparative Example 3 were evaluated in the same manner as in Example 1. The results obtained are shown in Table 2.

TABLE 2

| | | Formulation of Compounded Dye (part) | | | | Light |
|---|---|---|---|---|---|---|
| | Hue | Formula (9) | Formula (11) | Formula (12) | Formula (13) | Fastness |
| Example 2 | Ivory | 0.09 | 0.17 | 0.4 | 0.1 | Grade 3–4 |
| Comparative Example 3 | Ivory | 0.09 | 0.17 | 0.6 | — | Grade 2–3 |

EXAMPLES 3 AND 4

Dyed products were obtained in the same manner as in Example 1 except that a red dye represented by the following formula (14) (prepared by finely granulating a mixture of 30% of the dye bulk and 70% of an anionic surfactant and drying):

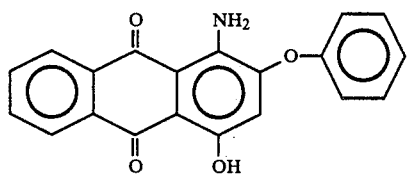

(14)

was added to the dyes of the formulae (9), (10), (11), (12) and (13) and these dyes were used with the formulations shown in Table 3.

As Comparative Examples 4 to 6, dyed products were obtained in the same manner as in Example 3 or 4 except that the dyes of the formulae (10) and (13) were not used (Comparative Example 4), the dyes of the formulae (10), (12) and (14) were not used (Comparative Example 5), and the dyes of the formulae (10), (13) and (14) were not used (Comparative Example 6), respectively.

The dyed products in Examples 3 and 4 and Comparative Examples 4 to 6 were evaluated in the same manner as in Example 1. The results obtained are shown in Table 3.

TABLE 3

| | Hue | Formulation of Compounded Dye (part) | | | | | | Light Fastness |
|---|---|---|---|---|---|---|---|---|
| | | Formula (9) | Formula (10) | Formula (11) | Formula (12) | Formula (13) | Formula (14) | |
| Example 3 | Crimson | 0.45 | 0.45 | 1.5 | 0.36 | 0.18 | 1.5 | Grade 3–4 |
| Comparative Example 4 | Crimson | 0.9 | — | 1.5 | 0.72 | — | 1.5 | Grade 2–3 |
| Comparative Example 5 | Crimson | 0.9 | — | 3.0 | — | 0.36 | — | Grade 2 |
| Example 4 | Dark Blue | 0.25 | 0.25 | 0.45 | 1.35 | 0.65 | 0.45 | Grade 3–4 |
| Comparative Example 6 | Dark Blue | 0.5 | — | 0.9 | 2.5 | — | — | Grade 2 |

EXAMPLES 5 AND 6

Dyed products were obtained in the same manner as in Example 1 except that 2 parts of an ultraviolet light absorber represented by the following formula (15) (prepared by finely granulating a mixture of 40% of the ultraviolet light absorber, 20% of an anionic surfactant, and 40% of water):

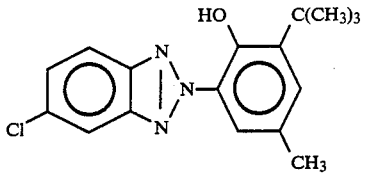

(15)

was added to the dyes of the formulae (9), (11), (12) and (13) and the formulation was changed as shown in Table 4.

As Comparative Examples 7 to 9, dyed products were obtained in the same manner as in Example 5 or 6 except that the dye of the formula (13) and the ultraviolet light absorber of the formula (15) were not used (Comparative Examples 7 and 9) and the ultraviolet light absorber of the formula (15) was not used (Comparative Example 8), respectively.

The dyed products obtained in Examples 5 and 6 and Comparative Examples 7 to 9 were evaluated in the same manner as in Example 1. The results are shown in Table 4.

TABLE 4

| | Hue | Formulation of Compounded Dye (part) | | | | | Light Fastness |
|---|---|---|---|---|---|---|---|
| | | Formula (9) | Formula (11) | Formula (12) | Formula (13) | Formula (15) | |
| Example 5 | Gray | 0.12 | 0.2 | 0.4 | 0.1 | 2.0 | Grade 4 |
| Comparative Example 7 | Gray | 0.12 | 0.2 | 0.6 | — | — | Grade 2–3 |
| Example 6 | Beige | 0.4 | 0.21 | 0.2 | 0.1 | 2.0 | Grade 4 |
| Comparative Example 8 | Beige | 0.4 | 0.21 | 0.2 | 0.1 | — | Grade 3–4 |
| Comparative Example 9 | Beige | 0.4 | 0.21 | 0.3 | — | — | Grade 2–3 |

EXAMPLES 7 TO 10

Crimson-dyed products were obtained in the same manner as in Example 3 except that each of dyes shown in Table 5 was used in place of the dye of the formula (10).

The dyed products were evaluated in the same manner as in Example 1. The results obtained are shown in Table 5.

TABLE 5

| | Dyes Used in Place of Dye of Formula (10) | Light Fastness |
|---|---|---|
| Example 7 | 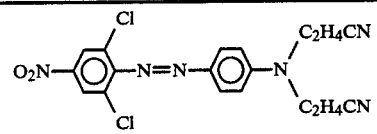 | Grade 3–4 |
| Example 8 | 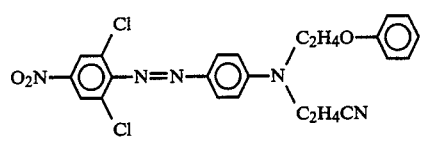 | Grade 3–4 |
| Example 9 | 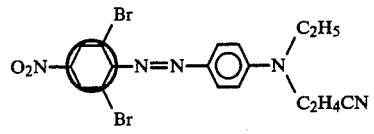 | Grade 3–4 |
| Example 10 | 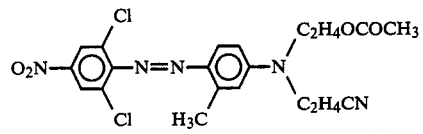 | Grade 3–4 |

EXAMPLES 11 TO 17

Crimson-dyed products were obtained in the same manner as in Example 3 except that each of dyes shown in Table 6 was used in place of the dye of the formula (14).

The dyed products were evaluated in the same manner as in Example 1. The results obtained are shown in Table 6.

TABLE 6

| | Dyes Used in Place of Dye of Formula (14) | Light Fastness |
|---|---|---|
| Example 11 | 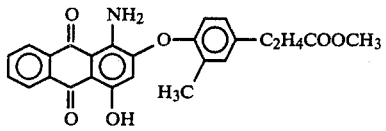 | Grade 3–4 |
| Example 12 | 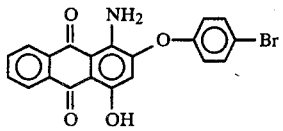 | Grade 3–4 |
| Example 13 | 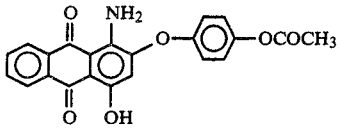 | Grade 3–4 |
| Example 14 | 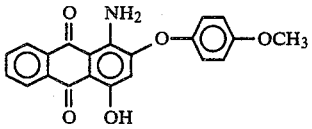 | Grade 3–4 |
| Example 15 | 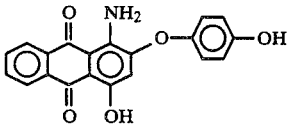 | Grade 3–4 |
| Example 16 | 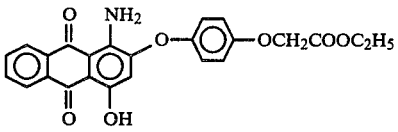 | Grade 3–4 |
| Example 17 | 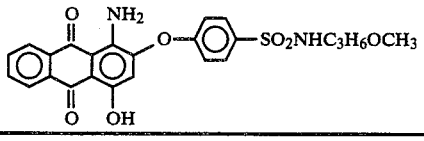 | Grade 3–4 |

EXAMPLE 18

By using a disperse dye composed of the same amounts of the dyes of the formulae (10), (11), (12) and (13) as used in Example 1, 0.9 part of a yellow dye of the following formula (16) (prepared by finely granulating a mixture of 30% of the dye bulk and 70% of an anionic surfactant and drying):

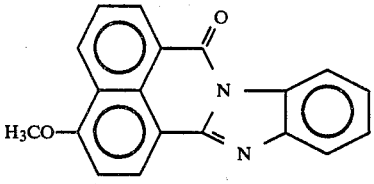

(16)

the dyeing was conducted, followed by reduction cleaning and then drying in the same manner as in Example 1. The dyed product thus obtained had a dark brown color.

As Comparative Example 10, a dark brown dyed product was obtained in the same manner as in Example 18 except that the blue dye of the formula (12) was not used and the amount of the blue dye of the formula (13) was changed to 1.35 parts.

As Comparative Example 11, a brown dyed product was obtained in the same manner as in Example 18 except that the blue dye of the formula (13) was not used and the amount of the blue dye of the formula (12) was changed to 2.7 parts.

The dyed products were evaluated in the same manner as in Example 1. The results obtained are shown in Table 7.

TABLE 7

| | Formulation of Compounded Dye (part) | | | | | |
|---|---|---|---|---|---|---|
| | Formula (16) (yellow) | Formula (10) (yellowish orange) | Formula (11) (red) | Formula (12) (blue) | Formula (13) (blue) | Light Fastness |
| Example 18 | 0.9 | 0.9 | 2.5 | 1.35 | 0.65 | Grade 3–4 |
| Comparative Example 10 | 0.9 | 0.9 | 2.5 | — | 1.35 | Grade 2–3 |
| Comparative Example 11 | 0.9 | 0.9 | 2.5 | 2.7 | — | Grade 2–3 |

EXAMPLE 19

By using a disperse dye composed of the same amounts of the dyes of the formulae (10), (11), (12), and (13) as used in Example 1, 0.4 part of a yellow dye of the following formula (17) (prepared by finely granulating a mixture of 30% of the dye bulk and 70% of an anionic surfactant and drying):

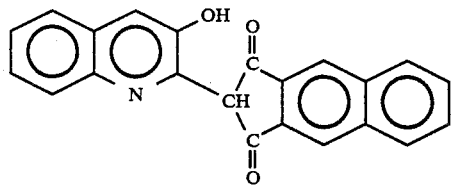

(17)

the dyeing was conducted, followed by reduction cleaning and then drying in the same manner as in Example 1. The dyed product thus obtained had a dark brown color.

As Comparative Example 12, a dark brown dyed product was obtained in the same manner as in Example 19 except that the blue dye of the formula (12) was not used and the amount of the blue dye of the formula (13) was changed to 1.35 parts.

As Comparative Example 13, a dark brown dyed product was obtained in the same manner as in Example 19 except that the blue dye of the formula (13) was not used and the amount of the blue dye of the formula (12) was changed to 2.7 parts.

The dyed products were evaluated in the same manner as in Example 1. The results obtained are shown in Table 8.

TABLE 8

| | Formulation of Compounded Dye (part) | | | | | |
|---|---|---|---|---|---|---|
| | Formula (17) (yellow) | Formula (10) (yellowish orange) | Formula (11) (red) | Formula (12) (blue) | Formula (13) (blue) | Light Fastness |
| Example 19 | 0.4 | 0.9 | 2.5 | 1.35 | 0.65 | Grade 3–4 |
| Comparative Example 12 | 0.4 | 0.9 | 2.5 | — | 1.35 | Grade 2–3 |
| Comparative Example 13 | 0.4 | 0.9 | 2.5 | 2.7 | — | Grade 2–3 |

EXAMPLE 20

A dark brown dyed product was obtained in the same manner as in Example 1 except that 0.8 part of a blue dye represented by the following formula (18) (prepared by finely granulating a mixture of 30% of the dye bulk and 70% of an anionic surfactant and drying):

(18)

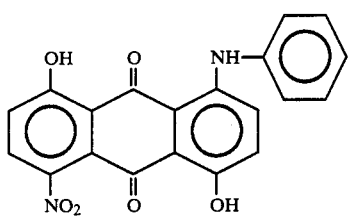

was used in place of 1.35 parts of the blue dye of the formula (12).

As Comparative Example 14, a dark brown dyed product was obtained in the same manner as in Example 20 except that the blue dye of the formula (18) was not used and the amount of the blue dye of the formula (13) was changed to 1.4 parts.

As Comparative Example 15, a brown dyed product was obtained in the same manner as in Example 20 except that the blue dye of the formula (13) was not used and the amount of the blue dye of the formula (18) was changed to 1.4 parts.

The dyed products were evaluated in the same manner as in Example 1 except that the irradiation time was changed to 400 hours. The results obtained are shown in Table 9.

TABLE 9

| | | Formulation of Compounded Dye (part) | | | | | |
|---|---|---|---|---|---|---|---|
| | Hue | Formula (9) | Formula (10) | Formula (11) | Formula (13) | Formula (18) | Light Fastness |
| Example 20 | Dark Brown | 0.9 | 0.9 | 2.5 | 0.65 | 0.8 | Grade 4 |
| Comparative Example 14 | Dark Brown | 0.9 | 0.9 | 2.5 | 1.4 | — | Grade 3 |
| Comparative Example 15 | Dark Brown | 0.9 | 0.9 | 2.5 | — | 1.4 | Grade 2–3 |

While the invention has been described in detail and with reference to specific embodiments thereof, it will be apparent to one skilled in the art that various changes and modifications can be made therein without departing from the spirit and scope thereof.

What is claimed is:

1. A method for dyeing polyester fiber materials comprising conducting combination dyeing by a combination of disperse dyes wherein at least one of said dyes is capable of compensating for the color fading of at least one other of said disperse dyes produced upon a degree of exposure of said material to sunlight, by the color change in hue caused in said at least one disperse dye under the same degree of exposure to sunlight, said combination of disperse dyes including as a blue disperse dye combination from 20 to 95% by weight of an anthraquinone dye of the general formula (I) and 80 to 5% by weight of an anthraquinone dye of the general formula (II):

(1)

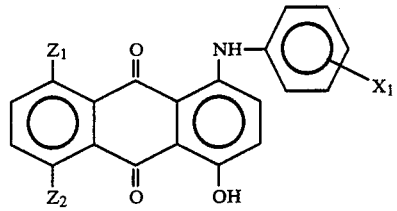

(2)

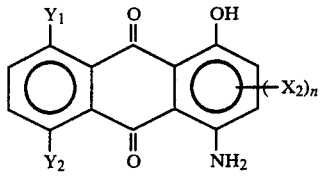

wherein $X_1$ is a halogen atom or a hydrogen atom; one of $Z_1$ and $Z_2$ is a nitro group and the other is a hydroxy group; one of $Y_1$ and $Y_2$ is an amino group and the other is a hydroxy group; $X_2$ is a halogen atom; and n is an integer of from 0 to 3.

2. A method as claimed in claim 1, wherein in addition to the blue disperse dye, at least one of dyes represented by the general formulae (3), (4) and (5):

(3)

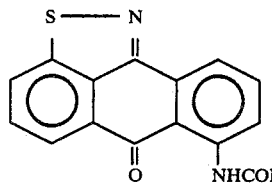

(4)

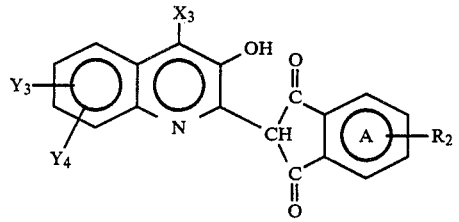

(5)

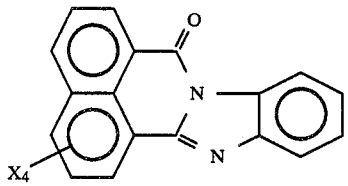

wherein $R_1$ is an alkyl group having from 1 to 4 carbon atoms or a phenyl group; $X_3$ is a hydrogen atom or a halogen atom; $Y_3$ and $Y_4$ are each a hydrogen atom or a halogen atom; $R_2$ is a hydrogen atom or an alkoxycarbonyl group; the ring A may be a naphthalene ring; and $X_4$ is a hydrogen atom, an alkyl group having from 1 to 4 carbon atoms, or an alkoxy group having 1 to 4 carbon atoms, or a mixture of at least one selected from the dyes of the general formulae (3), (4), and (5) and a dye represented by the general formula (6):

(6)

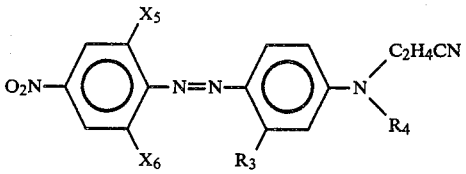

wherein $X_5$ and $X_6$ are each a halogen atom; $R_3$ is a hydrogen atom, a halogen atom, or a methyl group; and $R_4$ is a cyanoethyl group, an acetoxyethyl group, a benzoyloxyethyl group, or a phenoxyethyl group, is used as a yellow disperse dye.

3. A method as claimed in claim 1, wherein in addition to the blue disperse dye, at least one of dyes represented by the general formulae (7) and (8):

(7)

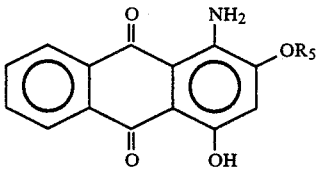

-continued (8)

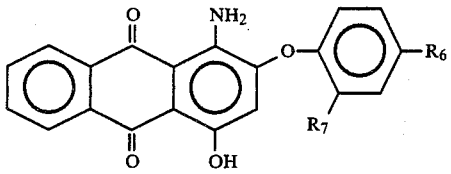

wherein $R_5$ is a substituted or unsubstituted alkyl group; $R_6$ is a hydrogen atom, a halogen atom, a substituted or unsubstituted alkoxy group, a substituted or unsubstituted alkyl group, an alkyl-substituted aminosulfonyl group, or an acyloxy group; and $R_7$ is a hydrogen atom or an alkyl group, is used as a red disperse dye.

4. A method as claimed in claim 1, wherein in addition to the blue dye, at least one of dyes represented by the general formulae (3), (4), and (5):

(3)

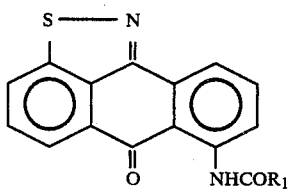

(4)

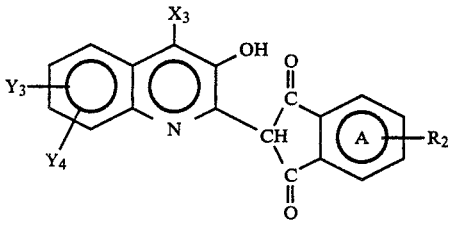

(5)

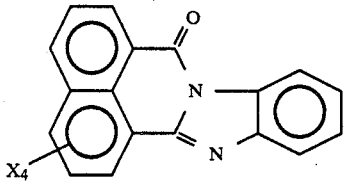

wherein $R_1$ is an alkyl group having 1 to 4 carbon atoms or a phenyl group; $X_3$ is a hydrogen atom or a halogen atom; $Y_3$ and $Y_4$ are each a hydrogen atom or a halogen atom; $R_2$ is a hydrogen atom or an alkoxycarbonyl group; the ring A may be a naphthalene ring; and $X_4$ is a hydrogen atom, an alkyl group having from 1 to 4 carbon atoms, or an alkoxy group having from 1 to 4 carbon atoms, or a mixture of at least one selected from the dyes of the general formulae (3), (4) and (5), and a dye represented by the general formula (6):

(6)

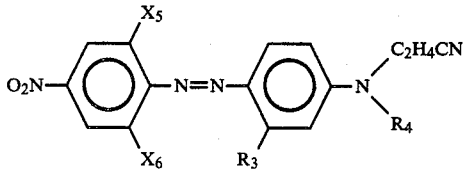

wherein $X_5$ and $X_6$ are each a halogen atom; $R_3$ is a hydrogen atom, a halogen atom, or a methyl group; and $R_4$ is a cyanoethyl group, an acetoxyethyl group, a benzoyloxyethyl group, or a phenoxyethyl group, is used as a yellow disperse dye, and at least one of dyes represented by the general formulae (7) and (8):

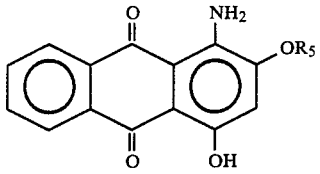

(7)

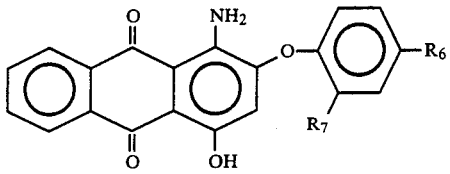

(8)

wherein $R_5$ is a substituted or unsubstituted alkyl group; $R_6$ is a hydrogen atom, a halogen atom, a substituted or unsubstituted alkoxy group, a substituted or unsubstituted alkyl group, an alkyl-substituted aminosulfonyl group, or an acyloxy group; and $R_7$ is a hydrogen atom or an alkyl group, as a red disperse dye, respectively.

5. A dye composition comprising as a blue disperse dye from 20 to 95% by weight of a dye of the general formula (1) and from 80 to 5% by weight of a dye of the general formula (2):

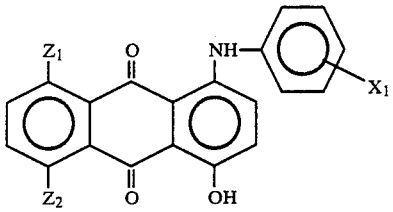

(1)

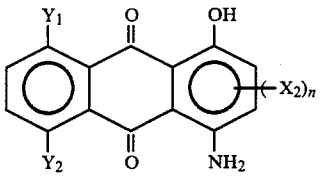

(2)

wherein $X_1$ is a halogen atom or a hydrogen atom; one of $Z_1$ and $Z_2$ is a nitro group and the other is a hydroxy group; one of $Y_1$ and $Y_2$ is an amino group and the other is a hydroxy group; $X_2$ is a halogen atom; and n is an integer of from 0 to 3.

6. A dye composition as claimed in claim 5, wherein said composition comprises from 5 to 95% by weight of the blue disperse dye, from 5 to 95% by weight of, as a yellow disperse dye, at least one of dyes represented by the general formulae (3), (4) and (5):

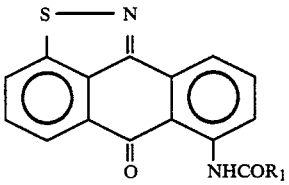

(3)

-continued

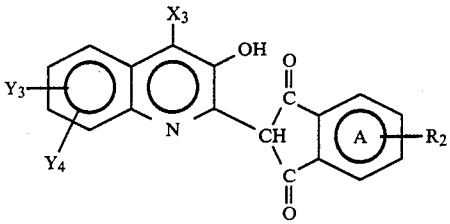

(4)

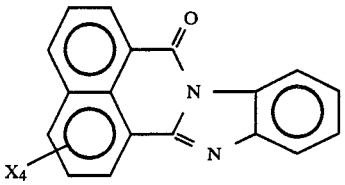

(5)

wherein $R_1$ is an alkyl group having from 1 to 4 carbon atoms or a phenyl group; $X_3$ is a hydrogen atom or a halogen atom; $Y_3$ and $Y_4$ are each a hydrogen atom or a halogen atom; $R_2$ is a hydrogen atom or an alkoxycarbonyl group; the ring A may be a naphthalene ring; and $X_4$ is a hydrogen atom, an alkyl group having from 1 to 4 carbon atoms, or an alkoxy group having from 1 to 4 carbon atoms, or a mixture of at least one selected from the dyes of the general formulae (3), (4) and (5), and a dye represented by the general formula (6):

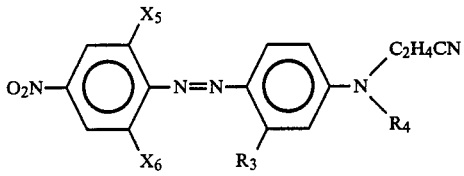

(6)

wherein $X_5$ and $X_6$ are each a halogen atom; $R_3$ is a hydrogen atom, a halogen atom, or a methyl group; and $R_4$ is a cyanoethyl group, an acetoxyethyl group, a benzoyloxyethyl group, or a phenoxyethyl group, and from 5 to 95% by weight, as a red disperse dye, at least one of dyes represented by the general formulae (7) and (8):

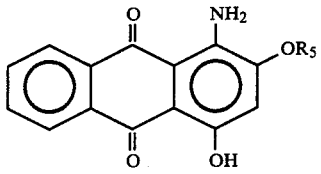

(7)

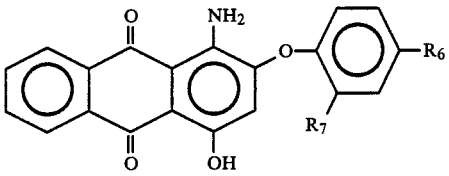

(8)

wherein $R_5$ is a substituted or unsubstituted alkyl group; $R_6$ is a hydrogen atom, a halogen atom, a substituted or unsubstituted alkoxy group, a substituted or unsubstituted alkyl group, an alkyl-substituted aminosulfonyl group, or an acyloxy group; and $R_7$ is a hydrogen atom or an alkyl group.

* * * * *